US009903040B2

(12) United States Patent
Feng et al.

(10) Patent No.: US 9,903,040 B2
(45) Date of Patent: Feb. 27, 2018

(54) METHOD FOR STRIPPING NITRIDE COATINGS

(75) Inventors: Jiangwei Feng, Painted Post, NY (US); Todd M Harvey, Elmira, NY (US); Shrisudersan Jayaraman, Painted Post, NY (US); Ljerka Ukrainczyk, Painted Post, NY (US)

(73) Assignee: CORNING INCORPORATED, Corning, NY (US)

( * ) Notice: Subject to any disclaimer, the term of this patent is extended or adjusted under 35 U.S.C. 154(b) by 1465 days.

(21) Appl. No.: 13/084,802

(22) Filed: Apr. 12, 2011

(65) Prior Publication Data

US 2011/0256807 A1 Oct. 20, 2011

Related U.S. Application Data

(60) Provisional application No. 61/324,526, filed on Apr. 15, 2010.

(51) Int. Cl.
*C25F 1/00* (2006.01)
*C25F 5/00* (2006.01)

(52) U.S. Cl.
CPC . *C25F 1/00* (2013.01); *C25F 5/00* (2013.01)

(58) Field of Classification Search
CPC ... C03B 11/00–11/10; C25F 3/00–3/30; C25F 5/00
USPC ..... 205/640
See application file for complete search history.

(56) References Cited

U.S. PATENT DOCUMENTS 3,554,881 A * 1/1971 Piontelli ..... 205/171
4,747,864 A * 5/1988 Hagerty et al. ..... 65/102
5,723,174 A * 3/1998 Sato ..... 427/133
6,531,049 B1 3/2003 Kariya et al.
6,969,457 B2 11/2005 MacDonald et al. ..... 205/674
7,077,918 B2 7/2006 Rauch et al.
2005/0263806 A1* 12/2005 Hayakawa et al. ..... 257/294
2005/0268662 A1* 12/2005 Moore et al. ..... 65/374.11
2006/0226025 A1* 10/2006 Mishra et al. ..... 205/640
2007/0186589 A1* 8/2007 Lung ..... 65/374.12
2009/0255805 A1 10/2009 Hanyu et al.

FOREIGN PATENT DOCUMENTS

DE 295879 A5 11/1991
JP H5-9743 * 1/1993 ..... C23C 18/50
JP H08296098 11/1996
JP 08325755 12/1996 ..... C25F 1/00
(Continued)

OTHER PUBLICATIONS

Ikeda et al., Phase formation and characterization of hard coatings in the TiAlN system prepared by the cathodic arc ion plating method, Thin Solid Films, vol. 195, Jan. 1991, 99-110.*
Sun et al., MREF-ECM Process for Hard Passive Materials Surface Finishing, J. of Mat'ls Processing Tech. 108, 356-368 (2001).*
(Continued)

*Primary Examiner* — James Lin
*Assistant Examiner* — Ho-Sung Chung
(74) *Attorney, Agent, or Firm* — John T. Haran

(57) ABSTRACT

Methods for stripping partially oxidized nitride wear or release coatings from metal workpieces comprise disrupting surface oxidation layers present on the coatings following use, and causing electrical current to flow from the workpiece and release coating to a counter electrode while the workpiece, release coating and counter electrode are immersed in an aqueous alkaline electrolyte solution.

18 Claims, 3 Drawing Sheets

(56) References Cited

FOREIGN PATENT DOCUMENTS

| | | | | |
|---|---|---|---|---|
| JP | 2000-44259 A | * | 2/2000 | ..... C03B 11/00 |
| JP | 2000044259 | | 2/2000 | ..... C03B 9/00 |
| JP | 2004143599 | | 5/2004 | ..... C25F 5/00 |
| JP | 2006111496 | | 4/2006 | ..... C03B 11/08 |
| JP | 2006257467 | | 9/2006 | |
| JP | 2010502830 | | 1/2010 | ..... C25F 7/00 |
| WO | 2008028311 | | 3/2008 | ..... C25F 7/00 |

OTHER PUBLICATIONS

Kawamura, JP 2000-44259 A, English Abstract (from Derwent) (2000).*
Kawamura, JP 2000-44259 A, Machine Translation (2000).*
Kawamura, JP 2000-044259, translation (2000).*
Sen, Y, "Stripping of CrN from CrN-Coated High-Speed Steels," Surfact and Coatings Technology, Elsevier, Amsterdam, NL, vol. 113, No. 1-2, Jan. 1, 1999.
Cristobal, A.B., "Electrochemical Stripping of Hard Ceramic Chromium Nitride Coatings," Thin Solid Films, Elsevier-Sequoia, S.A. Lausnne, CH, vol. 484, No. 1-2, Jul. 22, 2005, pp. 238-244.
English Translation of Notification of Grounds for Rejection for Japanese Application No. 2013-504967 , dated Feb. 3, 2015, 4 pages.
English Translation of Notification of Grounds for Rejection for Japanese Application No. 2013-504967, dated Oct. 20, 2015, 8 pages.
Leech et al; Reactive Ion Etching TiN, TiAIN, CrN, and TiCN Films in CF4/O2 and CHF3O2 Plasmas; Mater. Res. Soc. Symp. Proc. vol. 890, 2006 pp. 0890-Y08-13.1-0890-Y08-13.6.

* cited by examiner

METHOD FOR STRIPPING NITRIDE COATINGS

CROSS REFERENCE TO RELATED APPLICATIONS

This application claims the benefit of priority under 35 U.S.C. § 119(e) of U.S. Provisional Application Ser. No. 61/324,526, filed on Apr. 15, 2010.

BACKGROUND

Field of the Disclosure

The present disclosure relates to vapor-deposited or sputtered nitride coatings used to extend the service lives of metal tooling, and more particularly to methods for stripping nitride release coatings from tools such as metal glass molds that have been partially oxidized by the adverse conditions of use.

Technical Background

Evaporated or sputtered nitride coatings, including, for example, TiN, TiAlN, CrN, TiAlCrN, TiAlSiN, AlN and the like, have been used to improve the wear resistance of metal tooling ("wear" coatings) or to improve the release characteristics of metal surfaces ("release" coatings). One particularly demanding application for such coatings is as a release coating for glass molds. Advanced glasses for technical applications exhibit softening points in the range of 800° C., and molding complex shapes from such glasses requires the use of refractory metal molds with release coatings exhibiting physical as well as chemical stability at such temperatures. Nitride coatings, such as TiAlN coatings, applied by PVD (physical vapor deposition) can provide high temperature oxidation resistance, good release characteristics from softened glass, and high corrosion resistance for enhancing metal mold life and maintaining molded glass surface quality.

Nevertheless hard evaporated or sputtered coatings, including TiAlN coatings, can degrade after prolonged thermal cycling in contact with hot glass. Cracking of the coatings and degraded glass release properties are indicators of coating deterioration. In order to preserve and extend the service lives of the expensive glass molds used for the shaping of these glasses, an efficient process for stripping the nitride coatings from the molds is required. Further, the stripping process employed must leave mold surfaces in a condition suitable for the re-application of a new release coating.

Among the methods having potential application for the stripping of nitride wear coatings are DC or RF plasma etching, chemical stripping utilizing highly alkaline aqueous solutions with or without additions of oxidizers such as permanganates or peroxides, and electrochemical stripping. Plasma etching is slow and expensive, and typically requires line-of-sight access to the coated surface. Chemical stripping is also relatively slow, generally requiring the use of hot corrosive solutions that involve significant safety issues and process energy requirements, with multiple solutions of differing composition and temperature being needed to achieve full coating removal without substrate surface damage.

In contrast to wear coatings for conventional tooling, evaporated or sputtered nitride coatings employed as release coatings for glass molding applications present a unique stripping challenge due to changes in coating characteristics caused by the environment of use. Repeated thermal cycling to high temperatures during the pressing of molten glass articles causes substantial changes in composition as well as morphology in glass mold release coatings. Among the changes observed are the development of oxide phases in surface regions of the coatings that produce partially oxidized surface layers, and the formation of intermetallic phases due to the migration of metal species from the metal mold surfaces into base portions of the release coatings.

These changes, together with changes in crystallinity in the bulk coating material, cause substantial variations in stripping behavior, whereby treatments effective for removing an as-applied nitride coating system are ineffective for the stripping of the same system after prolonged thermal cycling of the coatings.

SUMMARY

The presently disclosed methods are directed to the stripping of PVD-applied nitride wear or release coatings from metallic substrates such as glass molds according to procedures that preserve metallic substrate quality and thus enable repeated re-coating and reuse of these expensive metal components. The disclosed methods enable the rapid and complete removal of thermally cycled mold release coatings, including durable TiAlN coatings, via an energy-efficient, low-voltage electrolytic stripping procedure that is effectively enabled through a preliminary reduction or removal of surface-oxidized material from the coatings.

In particular embodiments, the present disclosure encompasses a method for stripping a partially oxidized nitride release coating from a metal workpiece. The method comprises an initial step of disrupting a surface oxidation layer on the release coating to increase coating electrical conductivity. Thereafter an electrical current is caused to flow from the workpiece and release coating to a counter electrode while the workpiece, release coating and counter electrode are immersed in an aqueous alkaline electrolyte solution. Low electrical voltages applied at ambient or near-ambient temperatures are sufficient to achieve complete electrolytic stripping within reduced treatment intervals through the use of the disclosed method.

Evaporated or sputtered nitride coating removal through conventional chemical etching typically requires the use of hot (100-120° C.) highly alkaline solutions to achieve useful stripping rates, and post treatments with concentrated (30%) hydrogen peroxide or dilute hydrofluoric or other acids are often needed to remove stripping residues or release coating bonding layers. Such use is not required in accordance with the present disclosure. Moreover, stripping rates more than 10 times higher than those rates typical of chemical etching are achievable utilizing electrolytic stripping as above described, while the risk of $H_2O_2$ or HF damage to the stripped mold surfaces is completely avoided. Finally, the process energy requirements of the disclosed methods are greatly reduced in comparison with those required for chemical stripping. Still other advantages attending the use of the present methods will become apparent from the following detailed descriptions thereof.

BRIEF DESCRIPTION OF THE DRAWINGS

The methods of the present disclosure are further described below with reference to the appended drawings, wherein.

DETAILED DESCRIPTION

As will be apparent from the foregoing summary and following description, the stripping methods disclosed herein are applicable to the removal of a wide variety of nitride wear or release coatings from metal work pieces. Examples are coatings consisting essentially of one or more nitrides selected from the group consisting of TiN, TiAlN, CrN, TiAlCrN, TiAlSiN and AlN, with optional minor additions of modifying constituents, such as transition metal dopants, being permitted where appropriate for an intended application. The present methods, however, are found to provide particular advantages in cases where the workpiece is a glass molding element composed of a refractory, oxidation-resistant nickel-chromium alloy, and where the coating is a evaporated or sputtered TiAlN release coating that has undergone partial oxidation as the result of glass molding conditions encountered in use. Accordingly the following illustrative embodiments may refer particularly to such methods and materials even though the utility of those methods is not limited thereto.

As suggested above, release coatings consisting of PVD-deposited TiAlN layers impart excellent high temperature glass release characteristics to the surfaces of refractory alloy glass molding elements, and are sufficiently stable at the temperatures and redox conditions encountered during glass molding to protect the surfaces of such molds from damage over prolonged periods of use. As also noted above, it is possible to strip such coatings from glass molds using conventional chemical etching in, for example, alkaline KOH solutions, although such methods are impracticably slow and have high processing energy requirements.

Further difficulties arise where vapor-deposited TiAl interlayers are disposed between the metal mold surface and a TiAlN release coating. Such interlayers are generally useful for improving the adherence of vapor-deposited nitride coatings to metal surfaces, but are not effectively stripped by conventional electrochemical methods. Stripping solutions based on $H_2O_2$ and/or HF can remove such interlayers, but those solutions can damage the surfaces of nickel-chromium alloy molds, causing problems with re-coating and with molded glass surface quality following re-coating.

Figure 1:
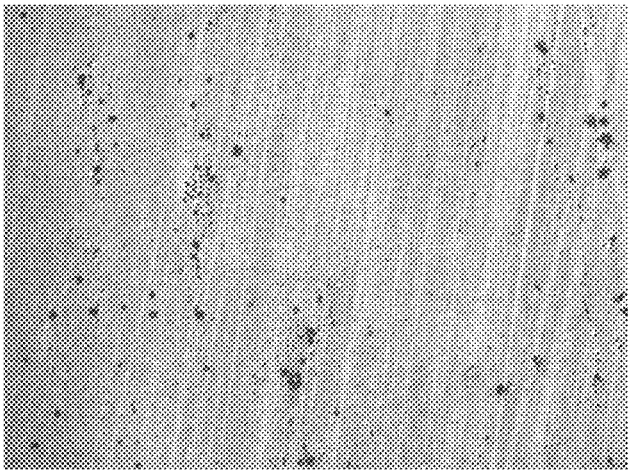
FIG. 1 is an electron photomicrograph of the surface of a nickel-chromium alloy mold surface following chemical stripping.

FIG. 1 of the drawings consists of an electron photomicrograph of a small section of the surface of an Inconel 718 nickel-chromium-alloy glass mold after a one-hour exposure to a 30% aqueous $H_2O_2$ etching solution. The extensive surface pitting of the alloy mold surface resulting from that exposure is evident from FIG. 1, and the level of damage seen there is substantially equivalent to the pitting occurring on exposure of the same mold material to HF stripping solutions.

Figure 5:
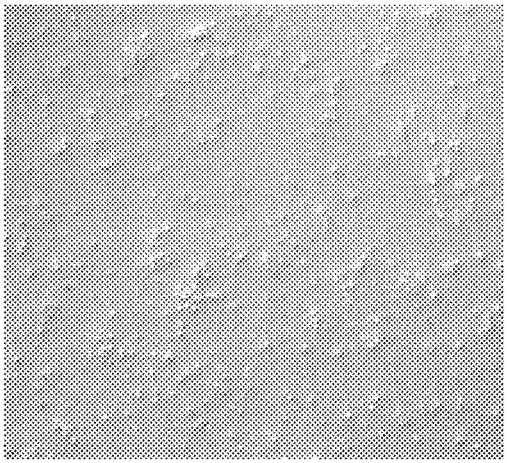
FIG. 5 is an electron photomicrograph of the surface of a nickel-chromium alloy mold surface after stripping in accordance with the present disclosure.

The surface damage shown in FIG. 1 contrasts strongly with the section of stripped mold surface of the same composition shown in the electron photomicrograph of FIG. 5. The latter surface is an Inconel 718 mold surface from which a TiAlN release coating was removed by electrolytic stripping in accordance with the present methods. The stripping step comprised a 15-minute interval in 10M KOH at a stripping voltage of 5V. The surface protrusions shown in FIG. 5 are hardened nodules characteristic of the Inconel 718 alloy structure, rather than a result of the stripping process.

While electrochemical treatments with alkali solutions are more effective than chemical stripping for the removal of TiAlN and TiAl coatings from conventional metal alloy tooling, such treatments have not been found effective to remove PVD-applied nitride coatings from alloy glass mold surfaces after a period of use of the molds. The ineffectiveness of such methods is now attributed to changes in coating composition and structure that result when the coatings are repeatedly cycled to high temperatures during the molding of high-softening point glasses.

Figure 2:
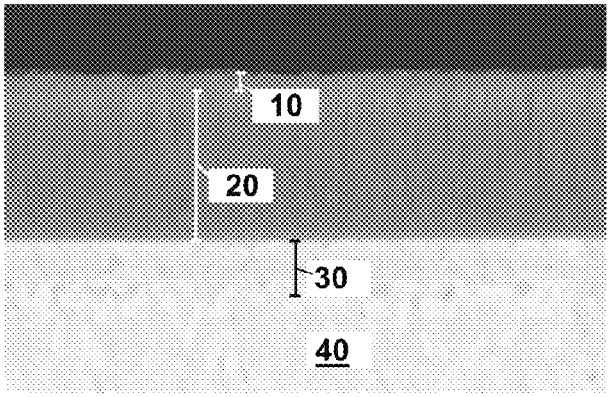
FIG. 2 is an electron photomicrograph of a portion of a cross-section of a nickel-chromium alloy glass mold provided with a TiAlN release coating after prolonged thermal cycling.

FIG. 2 of the drawings is an electron photomicrograph of a cross-section of a surface portion of a release-coated Inconel 718 nickel-chromium alloy glass mold 40, the release coating in FIG. 2 comprising a TiAlN surface coating 20 and a TiAl bonding interlayer 30. The release-coated glass mold is one that has undergone 500 thermal cycles during the molding of a series of curved alkali aluminosilicate glass plates at molding temperature near 800° C.

One effect of this thermal cycling that can be seen in FIG. 2 is the formation of an oxidized surface layer 10 on the surface of TiAlN coating 20, that surface layer having a thickness of about 169 nm and being composed mainly of aluminum oxide and titanium oxide. The low electrical conductivity of surface layer 10 is a factor blocking the effective electrochemical stripping of the partially oxidized coating.

An additional effect of thermal cycling is a change in the composition of TiAl interlayer coating 30 shown in FIG. 2. Chemical analyses of thermally cycled interlayer 30 indicates that the interlayer comprises a significant amount of an intermetallic material incorporating one or more diffused metal contaminants selected from the group consisting of iron, nickel and chromium, those contaminants having migrated into the interlayer from the underlying metal alloy glass mold surface during thermal cycling of the mold. Contaminated interlayer coatings of these compositions can undergo surface oxidation during electrochemical stripping, with the oxidized surfaces again blocking or retarding interlayer removal.

The steps employed in carrying out nitride coating removal in accordance with the present disclosure will depend on the thermal history of the coating and the changes in coating structure resulting therefrom. When the coating has undergone little or no thermal cycling, e.g., where it is disposed as a wear coating on conventional steel tooling, the coating retains an as-deposited composition and structure and can be removed by electrolytic stripping alone without damage to the tool surface.

On the other hand, where the coating has been subjected to extensive thermal cycling causing partial surface oxidation, the resulting surface oxidation layer is non-conductive, and electrolytic stripping at low voltages cannot effect coating removal. In the latter case, therefore, a step of disrupting the surface oxidation layer to a degree effective to increase the electrical conductivity of the partially oxidized coating is required, and a number of different procedures for achieving the necessary coating conductivity increase have been proven effective.

In one embodiment of a method comprising such a step, the surface oxidation layer is exposed to a concentrated aqueous alkali metal hydroxide solution to carry out chemical etching of the oxidized material. A particular example of such a treatment is to soak the mold or other workpiece in a 10M aqueous potassium hydroxide or sodium hydroxide solution for 15-30 minutes at 100° C. to at least partially dissolve the oxide layer. Depending on the size the mold, soaking in 45% KOH at 120° C. for 30-60 minutes can also be effective. Treatments of these durations are normally sufficient to increase the electrical conductivity of a TiAlN coating to a level sufficient to secure efficient electrochemical etching of the remaining TiAlN material at low applied voltages.

In another embodiment, the step of disrupting the surface oxidation layer comprises abrading the oxidation layer to at least partially remove oxidized material therefrom. The abrasive treatment employed should be one that is effective to breach the non-conductive oxide surface layer but not so intensive as to affect the surface morphology of the underlying mold. SiC sandpaper having a 1-3 μm grit size, or an aqueous suspension of alumina particles in the 0.5-9 μm particle size range, are examples of effective abrasives.

In yet another embodiment, disruption of the surface oxidation layer is accomplished by a modified preliminary electrolytic dissolution step carried out in an electrolytic cell of the kind useful for stripping remaining TiAlN coating materials from a mold. That procedure involves applying a higher voltage DC electrical pulse of relatively short duration across the cell while the mold or other workpiece is immersed in an aqueous alkaline electrolyte solution. As one example, a electrical potential drop in the range of 10-30V is applied across a partially oxidized TiAlN release coating disposed on a nickel-chromium alloy mold for a duration of less than one minute while both are immersed in an aqueous 5M KOH solution. That pulse can increase coating conductivity to a level allowing complete electrolytic stripping of the remaining TiAlN coating material to proceed at a 5V electrical potential drop in the same solution.

Figure 3:
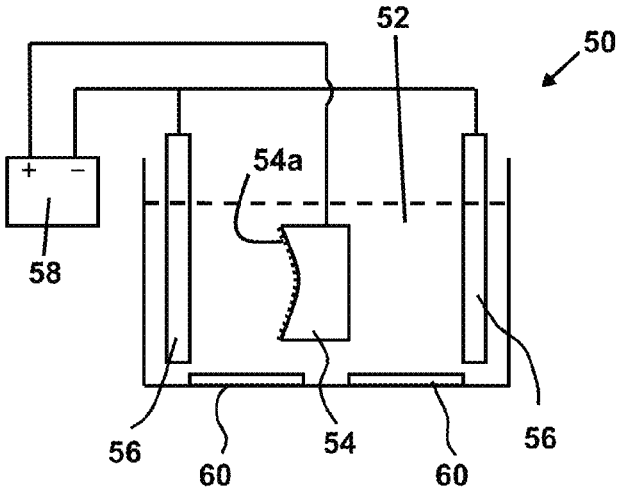
FIG. 3 is a schematic illustration of apparatus for carrying out nitride release coating stripping in accordance with the present disclosure.

As disclosed hereinabove, the electrolytic stripping of a vapor-deposited nitride wear or release coating from a metal workpiece in accordance with the presently disclosed methods involves flowing an electrical current through an electrolytic cell comprising an anode, a cathode and an electrolyte, with the coated workpiece constituting the anode of the cell. FIG. 3 of the drawing presents a schematic illustration of an electrolytic cell 50 suitable for stripping a nitride release coating from a metal mold or other workpiece in accordance with those methods.

Referring more particularly to FIG. 3, cell electrolyte 52 consists of an aqueous alkaline solution into which the coated workpiece or anode 54 is immersed. The cathode of the cell comprises one or more counter electrodes 56 that are suitably formed of a metal that is resistant to corrosion when serving as an electron donor in aqueous alkaline media.

In the operation of this cell, an electrical current is caused to flow from the workpiece 54 through a PVD-applied TiAlN release coating 54*a* and electrolyte 52 toward cathodic counter electrodes 56. The current results from the application of an electrical potential of relatively low voltage, e.g., 1-15 volts, across the anode and cathode by voltage source 58, that source being connected to the cell with the polarity or bias shown in the drawing. Cathodes (counter electrodes 56) for these electrolytic cells are suitably composed of a metal selected, for example, from the group consisting of platinum, titanium, niobium, steel alloys and nickel-chromium alloys, although other metals having the requisite alkali corrosion resistance could alternatively be used. In the illustrative apparatus of FIG. 3, a pair of ultrasonic transducers 60 are provided to energize electrolyte solution, although their use is not required.

Figure 6:
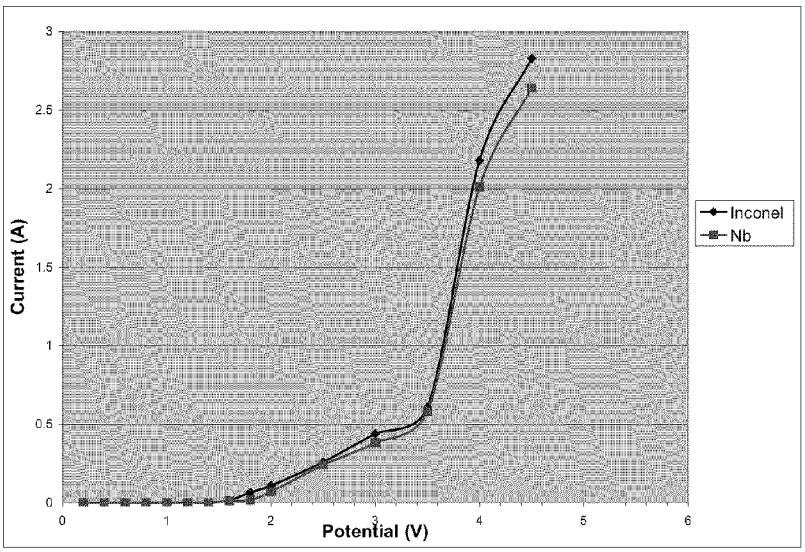
FIG. 6 is a plot of current as a function voltage (or current voltage (C-V) curve) of an as-deposited TiAlN coating.

FIG. 6 shows a plot of current as a function voltage (C-V) of the as-deposited TiAlN coating that did not go through any thermal cycles. FIG. 6 suggests that electron transfer is not initiated until about 1.6V to about 1.8V. At this point, current then increases linearly as voltage increases until about 3.5V, at which point another electron transfer reaction starts and the current increases exponentially as a function of voltage.

Figure 7:
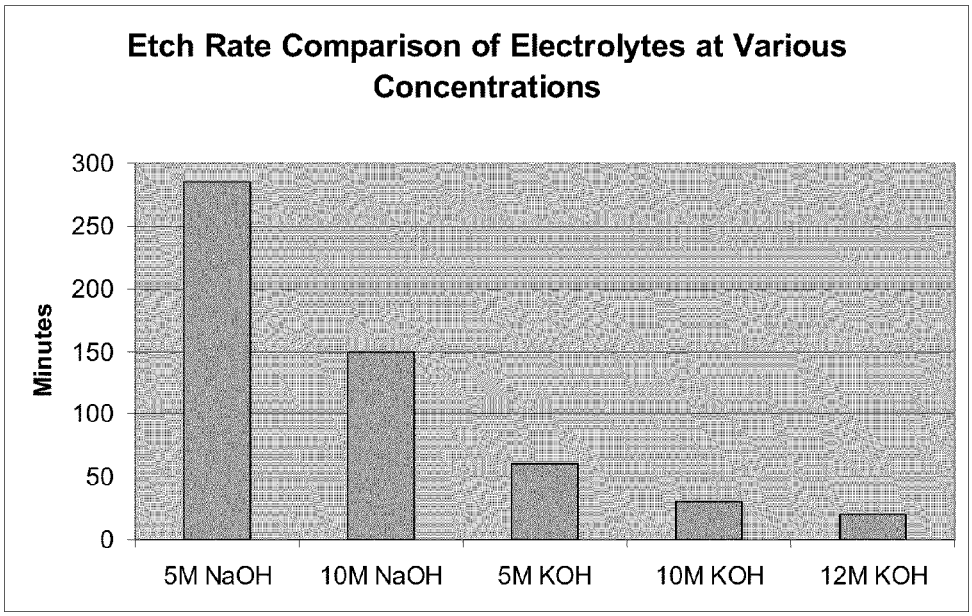
FIG. 7 is a plot of etching time required to remove a TIAlN coating using different kinds and concentrations of electrolytes.

In particular embodiments of these cells, the aqueous alkaline electrolyte solution employed comprises at least one compound selected from the group consisting of potassium hydroxide and sodium hydroxide. Alkali solutions with KOH or NaOH concentrations in the range of 1 molar to 12 molar (1M-12M) can provide rapid etching at the above cell voltages. As one example, effective TiAlN stripping can be accomplished with the application of a current-generating electrical potential in the range of 1V to 15V and, in some embodiments, about 3V to about 5V, across the electrolytic cell. KOH solutions are found to produce somewhat faster TiAlN dissolution than NaOH solutions under these conditions, as shown in FIG. 7.

Unfortunately, electrolytic stripping conditions that are highly effective for the removal of thermally cycled TiAlN release coatings as above described are not effective to remove the underlying interlayers of TiAl, Ti, Al, or the like used to bond release coatings to metal substrates. The intermetallic materials resulting from the diffusion of nickel, chromium and/or iron into the interlayers from the metal substrates during thermal cycling are prone to oxidation when biased as an anode in electrolytic cells such as shown in FIG. 3, that oxidation blocking current flow and thus dissolution of the interlayer.

Embodiments of the present methods that are effective to overcome this problem include a further processing step, following the stripping of the release layer. That step comprises passing electrical current pulses of reversing bias or polarity through the mold or other workpiece while immersed in an aqueous alkaline electrolyte solution. The alternating current pulses cause alternating oxidation and etching of the interlayer, and if continued for a sufficient time result in substantially complete dissolution of the interlayer.

Figure 4:
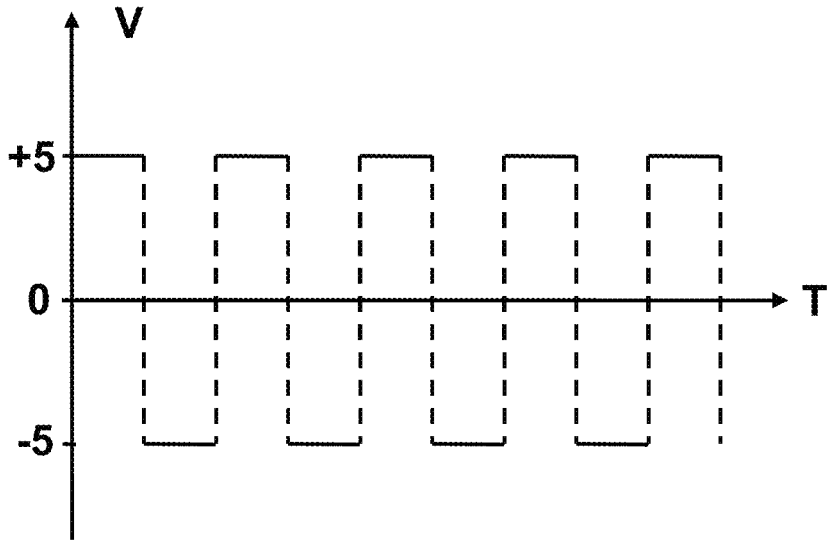
FIG. 4 is a plot of voltage versus time for an electrolytic treatment useful for interlayer stripping in accordance with the present disclosure.

FIG. 4 of the drawings is a plot of applied DC voltage versus time suitable for inducing alternating current pulses effective to remove a TiAl interlayer containing one or more diffused metal contaminants selected from the group of nickel, chromium and iron from a nickel-chromium alloy glass mold surface when treating the coated mold in apparatus such as shown in FIG. 3 of the drawings. Although equivalent positive and negative bias times are shown in FIG. 4, the periods of positive and negative bias can be independently adjusted to improve etching efficiency in any particular case. However, no changes in electrolyte solution composition are required to achieve efficient interlayer dissolution, and the energy requirements for conducting this step are low since no solution heating or voltage increases are necessary.

While the difficulty of interlayer removal is effectively addressed in accordance with the above described methods, there are some instances where partial or complete interlayer removal are not required. Adequate vapor-deposited nitride release coating re-bonding can instead be achieved in some instances simply by reconditioning the interlayer surface. Reconditioning can be achieved through a step of polishing the stripped surface of the interlayer remaining after release coating removal, for example using SiC sandpaper having a 1-3 μm grit size or an aqueous suspension of alumina particles in the 0.5-9 μm particle size range. As an illustrative example of such methods, the residual interlayer is touch-polished with a dispersion of 3 μm alumina particles in deionized water to achieve a suitable stripped mold surface quality.

Although the apparatus illustrated in FIG. 3 is well suited for the practice of the disclosed methods, variations in apparatus design can offer economic advantages in some cases. As one example, a two-compartment cell wherein the workpiece and the counter electrode are in two separate compartments with a salt bridge connecting the two compartments can provide the necessary path for ionic conductivity while minimizing cross contamination due to re-deposition of stripped coating material on the counter electrodes.

As previously described, the presently disclosed methods offer significant advantages over the use of harsh chemical stripping procedures for removing wear or release coatings from metal tooling. Electrochemical stripping requires substantially less process energy than chemical stripping, since smaller stripping solution volumes are effective, and since the required voltages and current densities are modest. Also little or no heating of the stripping solutions is required. In addition, process scale-up is straightforward and does not require large capital expenditures; only moderate increases in electrolyte bath volume and counter electrode size are needed. Finally, the disclosed electrochemical methods significantly reduce total stripping times, e.g., from several 10 s of hours to a few 10 s of minutes, while eliminating the need to use chemicals such as HF and $H_2O_2$ that can damage alloy surfaces, and that are difficult to store and handle safely.

While the methods of the present disclosure have been described above with respect to particular procedures, materials, and apparatus, it will be apparent to those skilled in the art that those particularly disclosed embodiments are merely illustrative of the various adaptations and modifications thereof that may be adapted to meet the requirements of related applications within the scope of the appended claims.

What is claimed is:

1. A method for stripping a partially oxidized nitride release coating from a metal workpiece comprising the steps of:

disrupting a surface oxidation layer on the release coating to increase release coating electrical conductivity, and flowing an electrical current from the workpiece and release coating to a counter electrode while the workpiece, release coating and counter electrode are immersed in an aqueous alkaline electrolyte solution.

2. The method in accordance with claim 1 wherein the nitride release coating consists essentially of one or more nitrides selected from the group consisting of TiN, TiAlN, CrN, TiAlCrN, TiAlSiN and AN.

3. The method in accordance with claim 1 wherein the release coating is a TiAlN coating deposited by evaporation or sputtering and wherein the workpiece is composed of a nickel-chromium alloy.

4. The method in accordance with claim 3 wherein the workpiece is a glass molding element.

5. The method in accordance with claim 1 wherein the counter electrode is composed of a metal resistant to corrosion in aqueous alkaline media.

6. The method in accordance with claim 5 wherein the counter electrode is composed of a metal selected from the group consisting of platinum, titanium, niobium, steel alloys, and nickel-chromium alloys.

7. The method in accordance with claim 1 wherein the aqueous alkaline electrolyte solution comprises at least one compound selected from the group consisting of potassium hydroxide and sodium hydroxide.

8. The method in accordance with claim 7 wherein the aqueous alkaline electrolyte solution is a 1M-12M aqueous solution of KOH or NaOH.

9. The method in accordance with claim 8 wherein an electrical potential not exceeding a range of about 1V to about 15V is applied between the workpiece and the counter electrode to generate the electrical current.

10. The method in accordance with claim 1 wherein the step of disrupting the surface oxidation layer comprises exposing the release coating to a concentrated aqueous alkali metal hydroxide solution for a time sufficient to at least partially dissolve the layer.

11. The method in accordance with claim 1 wherein the step of disrupting the surface oxidation layer comprises abrading the surface of the release coating to at least partially remove oxidized material therefrom.

12. The method in accordance with claim 1 wherein the step of disrupting the surface oxidation layer comprises applying a high voltage electrical pulse across the release coating.

13. The method according to claim 1, wherein the workpiece further includes an interlayer disposed between the release coating and the workpiece, and wherein the method further comprises removing at least a portion of the interlayer.

14. The method in accordance with claim 13, wherein the interlayer is a TiAl, Ti, or Al interlayer deposited by evaporation or sputtering.

15. The method in accordance with claim 14, wherein the TiAl, Ti, or Al interlayer contains at least one diffused metal contaminant selected from the group consisting of iron, nickel and chromium.

16. The method of claim 13, wherein the step of removing at least a portion of the interlayer comprises polishing the interlayer.

17. A method in accordance with claim 1 which comprises a further step of polishing a stripped surface of the workpiece.

18. A method for stripping a partially oxidized nitride release coating and at least a portion of an interlayer from a metal workpiece, the interlayer disposed between the release coating and the workpiece, the method comprising the steps of:

disrupting a surface oxidation layer on the release coating to increase release coating electrical conductivity;

flowing an electrical current from the workpiece and release coating to a counter electrode while the workpiece, release coating and counter electrode are immersed in an aqueous alkaline electrolyte solution; and removing at least a portion of the interlayer by passing electrical current pulses of reversing polarity through the workpiece for a time sufficient to dissolve the interlayer.

* * * * *